US005741194A

United States Patent [19]

Simunek

[11] Patent Number: 5,741,194

[45] Date of Patent: Apr. 21, 1998

[54] ADJUSTABLE BOUNDARY LAYOUT AND APPARATUS AND GAMES THEREFORE

[76] Inventor: William D. Simunek, 334 Archer Rd., Mahopac, N.Y. 10541

[21] Appl. No.: 671,403

[22] Filed: Jun. 27, 1996

[51] Int. Cl.[6] ..... A63B 71/00

[52] U.S. Cl. ..... 473/490

[58] Field of Search ..... 273/411; 473/490

[56] References Cited

U.S. PATENT DOCUMENTS

| | | | |
|---|---|---|---|
| 3,226,118 | 12/1965 | Nehl | 273/411 X |
| 3,393,913 | 7/1968 | Safina | 273/411 X |
| 3,968,968 | 7/1976 | Peterson | 273/411 |
| 3,985,359 | 10/1976 | Moore | 273/411 |
| 4,185,819 | 1/1980 | Hartley | 273/425 X |
| 4,433,838 | 2/1984 | Gordon | 273/411 X |
| 4,834,392 | 5/1989 | Nixon | 273/411 |
| 4,880,243 | 11/1989 | Raub | 273/411 |
| 5,356,132 | 10/1994 | McEwan et al. | 273/425 X |

*Primary Examiner*—William H. Grieb

[57] ABSTRACT

An adjustable boundary layout and apparatus for outlining shapes and figures or a playing field of any dimension, made up a plurality of detachably connected flexible cords (10) attached by connectors (14) and assembled to the shape desired at the time of usage. The boundaries are stored and transported on a spool (18) or hook (55). The necessary number of cords can be unwound or rolled off spool and detached at the end of any cord. Cords and connectors can be arranged to form endless loops and can intersect through the use of various connectors with multiple joints. Connectors with cross-cut holes (15) are used to create a point of intersection at any point along the cords. Any number of separate boundary demarcations can be formed of any dimensions and any distance apart. In a preferred embodiment of the playing field, individual boundary demarcations of varying sizes depending on skill level and space limitations are formed for each player. Each individual occupies one boundary and a ball is hit or tossed attempting to have the ball land within an opponent's boundaries. The game can be played with an odd number of players with or without teams and the separation between individual boundaries creates the affect of a net. Specific paddles (74D) and (74S) enhance the uniqueness and effectiveness of the boundary system. The boundaries also provide an effective way to simulate lacrosse game conditions in the absence of a goal and promote the development of stick skills. Since the boundaries are detachable, of limited length, and not limited to one boundary demarcation, the utility of the system goes beyond that of the demarcations of a ball playing field and promotes the use of multiple and florescent colors in the creation of very complex and enlarged configurations. With the added capability of containing chemicals with glow properties, the boundary system can be used day or night.

15 Claims, 10 Drawing Sheets

10
14
12J
12K
12L
12H

ADJUSTABLE BOUNDARY LAYOUT AND APPARATUS AND GAMES THEREFORE

CROSS REFERENCES TO RELATED APPLICATIONS

This patent is related and complimentary to the Provisional Patent of same name filed on Jun. 28, 1995 through Curtis, Morris, Safford, P.C.—CMS ref.: 590081-2000, Ser. No.: 60/000,827.

This patent relates to several applications of the same set of materials for the purpose of creating games and art, as well as a boundary system and equipment for ball games.

BACKGROUND—FIELD OF INVENTION

This invention relates to the marking of boundaries for any playing field and the outlining of any figure via a portable and adjustable demarcation system.

BACKGROUND—DESCRIPTION OF PRIOR ART

Boundaries exist in many forms. One major function is to identify the field of play for a multitude of sports and games. Many informal games are played, however, without actual boundaries, thus limiting their scope and competitiveness. Formal sports are usually played on courts or fields that are defined by permanent lines. Heretofore, several portable boundaries have been designed as well. Each has significant drawbacks such as limited scope and functionality thus resulting in limited use in the market.

Peterson et al., U.S. Pat. No. 3,968,968 designed a boundary system for a mini volleyball game. It is comprised of a net and a unitary length of flexible cord weighted at the corners. Its purpose is limited to the creation of a rectangular playing court of a predetermined size.

Nixon et al., U.S. Pat. No. 4,834,392 describes various rectangular boundary systems having a foul zone and dimensions of predetermined and unalterable sizes. Each system is of a different size but there is no means to use one boundary system to create all the various court sizes suggested. The patent generally refers to establishing courts without walls and anchored by weights that can be used to play games with similar rules to that of racquetball.

Moore et al., U.S. Pat. No. 3,985,359 designed a system of cords permanently assembled and stored on a spool. By simply unwinding the spool and spreading the cords into the predetermined position, the court layout will be formed. This system is limited to one court assembly which is rectangular and packaged as a single unitary piece of predetermined dimensions. The spool is also limited in functionality with predetermined sections divided by a predetermined number of discs.

Nehl et al., U.S. Pat. No. 3,226,118 designed a collapsible boundary frame assembled of rigid, straight rails and rigid sleeves. The four right angle sleeves are permanently connected at both ends of the rails representing the width of a court thus limiting the court width to one size. Complete assembly also requires lining up holes and screwing rails to sleeves that intersect the middle of a court. Though collapsible, the system appears designed for permanent assembly.

Raub et al., U.S. Pat. No. 4,880,243 also designed a portable playing court with emphasis on the ability to create sharply defined square playing court corners using a single continuous boundary defining element such as rope or cloth tape. The boundary is of predetermined length and has the sole utility of creating a boundary of specific dimension. At corner points along the rope, attachment means are permanently affixed such that anchoring devices can be used to secure the boundary from outside the playing area. Raub indicated that this was one of the advantages his system had over prior art since anchoring devices along the court present hazards. During the course of most games, however, players will step out-of-bounds and thus be subject to the hazards that all anchors present.

While each of the aforementioned patents provides a portable boundary system, all are heretofore known suffer from a number of disadvantages:

a) With the exception of Nehl's patent being manufactured as smaller rigid pieces, each of the other systems for marking a playing court is manufactured as one piece.

b) Use of a rigid piece system, such as that described by Nehl, is restrictive in the dimensions it is capable of forming, each piece representing a specific part of the total boundary. The rigid pieces also present hazards which could lead to injuries.

c) Each is manufactured of a predetermined and distinct overall dimension and though capable of being manufactured of various dimensions, one would have to purchase a complete system for each dimension desired. All are manufactured for the sole utility of forming a specific rectangular boundary. Thus, boundaries cannot be altered, based on space limitations, game type, or skill levels, at the time of usage, nor can a single boundary system be used for multiple purposes simultaneously.

d) The boundary systems are limited in scope by either the need for a net or by the predetermined size of foul zones.

e) Each is manufactured of a distinct color or specific combination of colors that cannot be altered. They do not lend themselves to the production of multicolored designs of the user's choosing nor the production of a glowing system.

No one has come up with a truly multiple use system that is made up of a plurality of detachably attached pieces that will inspire creative use by both adults and children. Nor has anyone devised a boundary system that is capable of emitting light.

OBJECTS AND ADVANTAGES

Accordingly, several objects and advantages of my invention are:

a) to provide a single portable system made up of multiple pieces for creating boundaries of various dimensions and shapes determined by the user at the time of each usage, one which can be used on many surfaces and for a variety of games and sports;

b) to provide a boundary system for use with the informal paddle and ball games on the market, thus creating the framework for transforming the fun activity of hitting a ball back and forth into a game or sport with rules guided by the creation of an actual field of play, the size of which is determined with each usage by space limitations and skill level of the players;

c) to provide a flexible, detachable boundary system which can be formed into any number of isolated and individual boundaries that can be separated any distance, eliminating the need for a net while not limiting the fault area to a specific dimension;

d) to provide, with a single boundary system, the ability to create boundaries that can be constructed to approximate or specific dimensions with or without precise right angles;

e) to provide a boundary system that can easily be set up with single or multiple intersections at any point, thus enabling the formation of both simple and complex configurations, of exact or approximate dimensions, promoting creativity;

f) to provide a boundary system that will maximize the utility for both adults and children by having an unlimited total length that is detachable and can be reduced to lessor lengths and reattached to its original length;

g) to provide a boundary system with interchangeable pieces of various colors that do not represent specific parts to a specific design, designed for multiple uses simultaneously and to inspire creativity;

h) to provide a safe boundary system of flexible material having sufficient weight such that it does not require anchoring which could lead to injuries and one which will disconnect if tugged on reducing the possibility of tripping.

Another object of the invention is to provide actual game rules for an odd or even number of players utilizing the boundary system in combination with either the current paddles, sticks, and balls on the market or with the uniquely designed paddles of the invention.

Another object of the invention is to provide a single multipurpose system that is easily assembled, disassembled, sectioned and stored ready for the next use, or ready for multiple uses simultaneously in different locations.

Another object of the invention is to provide a boundary system which can be produced of materials through which glowing light can be emitted enabling usage day or night.

Still further objects and advantages will become apparent from a consideration of the ensuing description and accompanying drawings.

BRIEF DESCRIPTION OF THE DRAWINGS

FIGS. 3A-1–3A-5, and 3B-1–3B-4 are combinations of views illustrating various storage means.

FIGS. 5A-1–5A-4, 5B-1 and 5B-2 are plan views of the present invention illustrating two embodiments for arranging the boundaries for team play.

REFERENCE NUMERALS

Figure 1A:
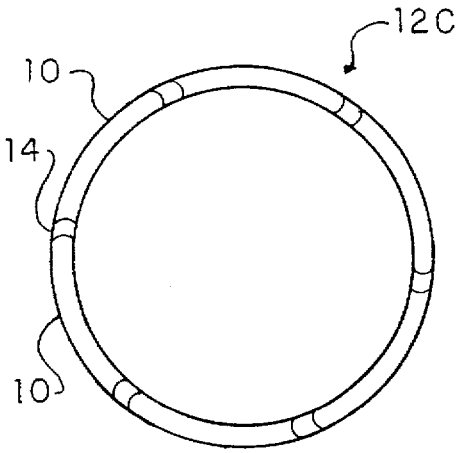
FIGS. 1A–1C are overall views of the present invention comprising a field of play created with three individual boundaries each of different dimension.

10 cord
10M solid cord
10F hollow cord
10S cloth tape cords
11B blunt end
11T tapered end
11R round end
12A four cord boundary
12B five cord boundary
12C six cord boundary
12D eleven cord boundary
12E nine cord lacrosse boundary
12F rectangular boundary with right angles
12G rectangular boundary with rounded corners
12H golf green boundary, two-putt range
12I one putt range boundary
12J cup boundary
12K sand trap boundary
12L water hole boundary
12M flower boundary
12N word boundary
12O spiral boundary
12P figure eight boundary
12Q hop scotch boundary
12R big dipper boundary
12S outside of house boundary
12T inside of house, room boundary
13 sliced edge
14 connector
14C sliced edge connector
14F hollow connector
14M solid connector
14S solid connector with stop
14V cloth tape connector
15 cross-cut hole
15S cross-cut hole on sliced edge
17 stop
18 spool with rod
18D spool with dividers
18A arbor hole handled spool
19 ruler markings
20 barrel
22 flange
24 traverse
26 arbor hole
26A barrel sized arbor hole
28A arbor hole handle
28R rod handle
28C neck handle
29 legs
30 track
32 knob
33 handle lip
35 pegs
35A wide pegs
36 slots
38 rod
40 arm
41 extensions
41N neck extension
42 opening
44 cap
45 bolt hole
46 bolt
48 nut
50 neck
70A hollow ball
70B ball with holes
71 seal
72 flat surface 73 curved shovel edge
74D paddle disc
74C paddle cone
74R round paddle
74S shovel paddle
75 curved lip
75A right angle lip
75B slanted lip
75S curved shovel lip
76 cutout
77 grip
78L lacrosse stick
78J jai alai stick
79 shaft
80 socket
81 channel
82 screw

PREFERRED EMBODIMENT—DESCRIPTION

Figure 1B:
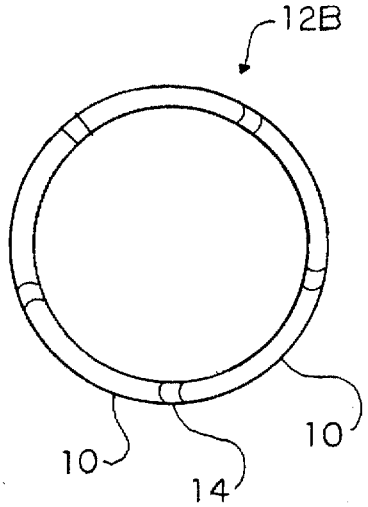
Figure 1C:
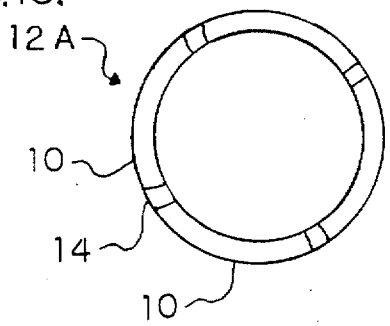

FIGS. 1A–1C—Basic boundary configuration. FIGS. 1A–1C comprise one basic configuration of the boundary system according to the present invention. The boundaries consist of lengths of flexible material such as rope, string, cord 10 attached by two-ended fasteners, joints, connectors 14 and shaped into the desired configuration. FIGS. 1A–1C illustrate a field of play with one boundary 12A of four cords 10 and connectors 14, one boundary 12B of five cords 10 and connectors 14, and one boundary 12C of six cords 10 and connectors 14, each shaped to approximate a circle. The dimensions and distance between boundaries is determined by space limitations and skill level of the participants.

FIG. 2A-1–2A-9, 2B, 2C, 2D, 2E-1–2E-3, 2F, 2G-1–2G-4 and 2H—Isolated view of cords 10 and connectors 14. These Figures provide isolated views of cords and connectors in the present invention. As illustrated in FIGS. 2A-1–2A-9, solid cords 10M and hollow cords 10F are of flexible material, such as rubber, plastic, polyethylene, cloth tape, or rope. The ends of cords 10 are constructed according to the type of material and connector 14 used. Solid cord 10M (male) is of pointed or tapered ends 11T, rounded ends 11R, blunt ends 11B, etc. The length of cords 10 can vary but optimum use of the boundary system would suggest that cords 10 be of lengths from one to fifteen feet for most purposes and from eight to fifteen feet for the various boundary ball games of the present invention.

With solid cord 10M (male) made of polyethylene, connectors 14F (female) are of tubing, open at both ends, an inside diameter equal to or greater than diameter of cord 10M, capable of expansion about cord 10M such that it provides a snug and easy fit. Connectors 14F are of flexible material similar to that of cords 10F. More rigid clips and snaps or hook and loop fasteners are used with cords 10 made of other materials. Connectors 14F should be of a short enough length and small enough diameter such that cords 10M attached with connectors 14F lay evenly about a sphere and hooks for storage. Longer length connectors 14F are flexible and bend about sphere and hook.

With hollow cords 10F, flexible solid connectors 14M and 14S, or a rigid hollow connector 14F of a diameter less than cord 10F, is inserted into cords 10F at either end to create the extended length. Connector 14S has a stop 17 of a diameter greater than that of cord 10F such that connector 14S cannot be inserted into cord 10F past stop 17.

By adding a cross-cut hole 15, of a diameter greater than that of cords 10M and 10F, to connectors 14F-1 and 14M-1, a point of intersection can be created.

Cords 10M and 10F are of any color, preferably bright or florescent. Hollow cords 10F are of a material through which glowing light can be emitted and into which chemicals, and tubes of chemicals, with glow properties can be inserted.

Figures 1, 2A:
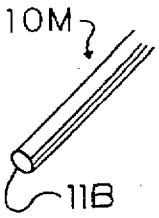
FIGS. 2A-1–2A-9, 2B, 2C, 2D, 2E-1–2E-3, 2F, 2G-1–2G-4 and 2H are perspective views of the demarcation elements and connecting elements also illustrating the various means of attachment.
Figures 2, 2A:
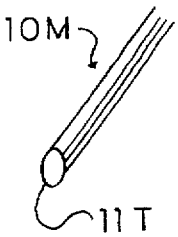
Figures 2, 2A, 3:
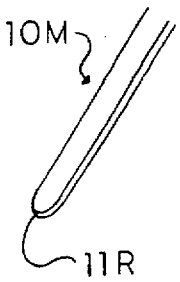
Figures 2, 2A, 3, 4:
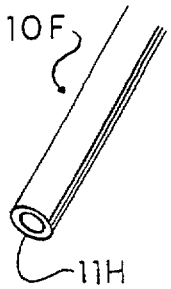
Figures 2, 2A, 3, 4, 5:
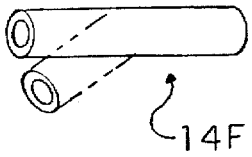
Figures 2, 2A, 3, 4, 5, 6:
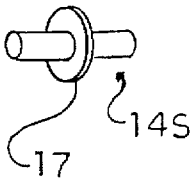
Figures 2, 2A, 3, 4, 5, 6, 7:
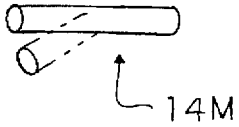
Figures 2, 2A, 3, 4, 5, 6, 7, 8:
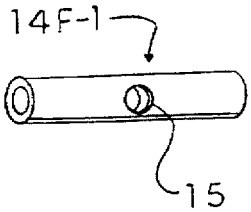
Figures 2, 2A, 3, 4, 5, 6, 7, 8, 9:
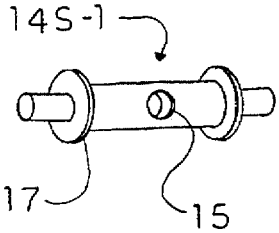
Figure 2B:
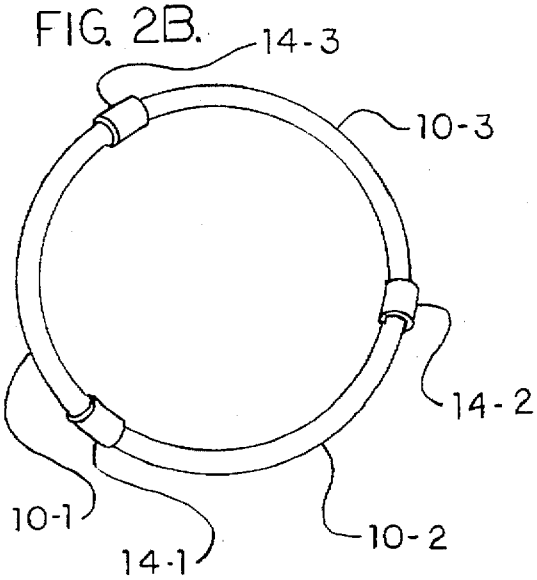

FIG. 2B illustrates how to create an extended length and form a shape. Start by inserting one end of cord 10-1 into one end of connector 14-1. Take second cord 10-2 and insert one end into opposite end of connector 14-1. Insert opposite end of cord 10-2 into one end of second connector 14-2. This is be repeated with any number of cords and connectors until the desired length is obtained. As illustrated, by inserting open end of first cord 10-1 into open end of last connector 14-3, the boundary system can be constructed to form a continuous element.

Figure 2C:
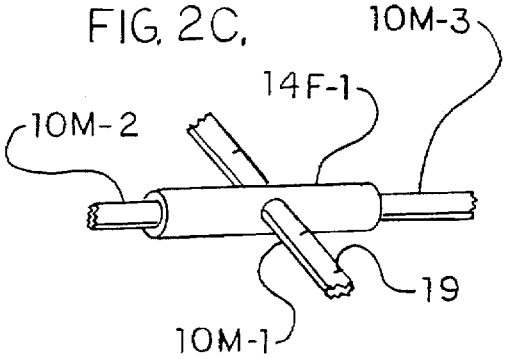
Figure 2D:
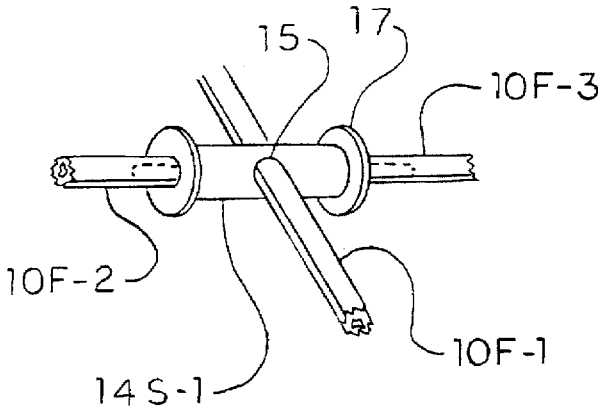
Figures 1, 2E:
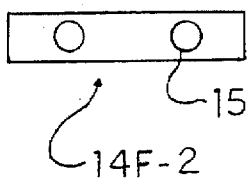
Figures 2, 2E:
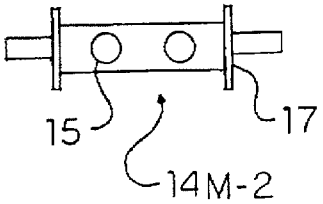
Figures 2, 2E, 3:
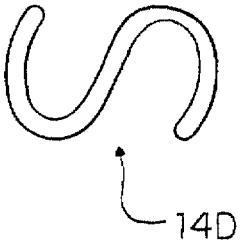

The creation of intersections through the use of cross-cut holes 15 is illustrated in FIG. 2C and FIG. 2D. As shown in FIG. 2C, by inserting cord 10M-1 through cross-cut hole 15, connector 14F is slid along cord 10M-1 and thus situated at any point along cord 10M-1 creating a point of intersection for cord 10M-2 and Cord 10M-3. Cord 10M-2 and cord 10M-3 are inserted into opposite open ends of connector 14F up to but not intersecting cross-cut hole 15. Connectors 14F are lined up with ruler markings 19 on cord 10M-1 to obtain specific lengths and precise dimensions.

FIG. 2D illustrates an embodiment of solid connectors 14S with stop 17 and cross-cut hole 15 to be used with hollow cords 10F. Connectors 14S-1 are of a solid flexible material at the ends, and a cross-cut hole through a hollow or solid middle section, the diameter of cross-cut hole 15 equal to or slightly greater than that of the outside diameter of cord 10F. By inserting cord 10F-1 through cross-cut hole 15 of connector 14S-1, connector 14S-1 slides along cord 10F-1 and is situated at any point along cord 10F-1 creating a point of intersection for cords 10F-2 and 10F-3.

FIGS. 2E-1–2E-3 illustrate connectors 14F-2, 14M-2, and 14D that connect parallel, overlapping and intersecting cords 10M and 10F. Connector 14M or 14F with more than one cross-cut hole 15 can receive more than one cord 10F or 10M creating a point of overlap or intersection. By using the ruler markings 19 illustrated in FIG. 2C, the amount of overlap can be determined in order to create the desired length. With "S" shaped connector 14D, cords 10M or 10F are pressed into place on either side of "S" connector 14D.

Figure 2F:
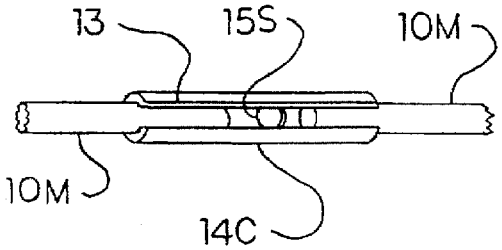
Figures 1, 2G:
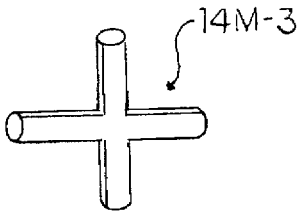
Figures 2, 2G:
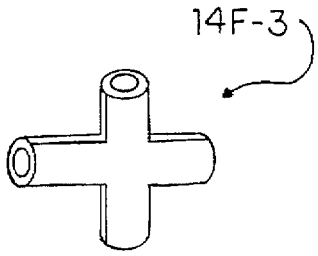
Figures 2, 2G, 3:
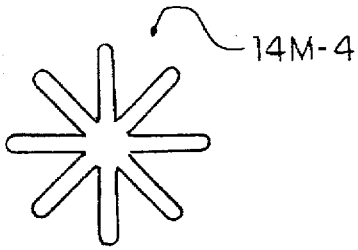
Figures 2, 2G, 3, 4:
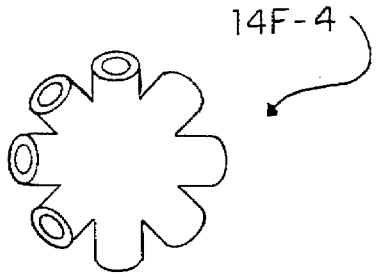

FIG. 2F illustrates a connector 14C with a sliced edge 13 and a cross-cut hole 15S. Cord 10M or 10F is inserted through open ends or pressed into expandable sliced edge 13 without crossing cross-cut hole 15S. A third cord 10M or 10F, not shown, can be inserted through cross-cut hole 15S.

FIGS. 2G-1–2G-4 illustrate connectors 14M3, 14F3, 14M4 and 14F4 with multiple points of intersection. Connectors 14M-3 can be connected with four cords 10F. Connector 14M-4 can be connected with eight cords 10F. Connectors 14F-3 can be connected with four cords 10M and connectors 14F-4 can be connected with eight cords 10M. Cords not shown in FIG. 2G.

Figure 2H:
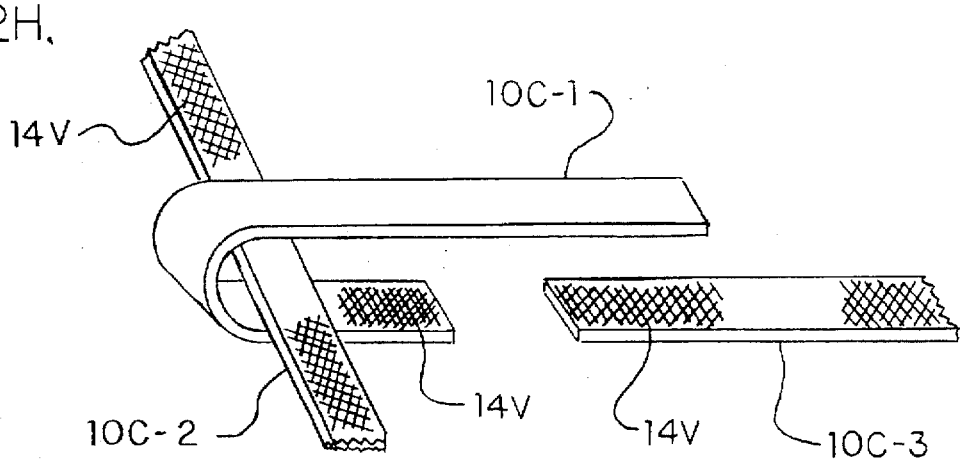

FIG. 2H, illustrates cloth tape cords 10C with permanently attached hook and loop fasteners 14V used to create extended lengths. The extended lengths are created by attaching cord 10C-1 with hook and loop fasteners 14V to cord 10C-3 with hook and loop fastener 14V. Extended lengths are also formed by creating a loop with cord 10C-1 about another cord 10C-2 attaching cord 10C-1 to itself and attaching cord 10C-2 to itself.

FIGS. 3A-1–3A-5, B, C, D—Spool 18 for storage, transport, assembly. These figures comprise various reels or spools 18 in the present invention, used to store and transport the boundary system consisting of cords 10 and connectors 14 and to facilitate assembly and disassembly. Spools 18, made of plastic, polyethylene, wood, metal, or other rigid, light weight material, can be constructed to various dimensions with enough depth and width to hold multiple cords 10 as a unitary piece with each cord 10 attached to an adjacent cord 10 by connector 14. An inside diameter, barrel 20 of spool 18 is of a dimension sufficient enough to allow cords 10 and connectors 14 to lay flat along barrel 20 of spool 18 without twisting, tangling, disconnecting or bulging. Flanges 22 provides up to several inches of height beyond barrel 20 and traverse 24 up to several inches of depth which will allow a single spool 18 to maintain a plurality of cords 10, up to several hundred feet.

The size of an arbor hole 26 is determined by the method desired for holding spool 18. An arbor hole 26 is of a minimum diameter such that a pole or rod 38 passes through and supports spool 18 for the purpose of carrying and about which spool 18 rotates as cords 10 are wound on or off. An arbor hole 26A, has a maximum diameter equal to barrel 20. With the larger diameter, spool 18 is held by placing a hand within arbor hole 26A. Arbor hole 26A is of a sufficient diameter for any size hand to fit inside to grasp spool 18 while transporting or while winding cords 10 on or off spool 18.

Multi sectioned spools 18D are used to separate cords 10 of different lengths, colors and the like. Additional flanges 22, not shown, can be added at intervals along barrel 20. As illustrated in FIGS. 3A-1–3A-5, spool 18D is divided into sections by pegs 35 and 35A that are snapped into slots 36 along barrel 20 at several points.

Another means of creating sections to separate cords 10 would be to create a system of several spools on a single rod separated by washers, not shown.

FIGS. 3B-1–3B-4 comprise embodiments of a handle 28A and 28R used to carry spool 18 of the present invention. Handle 28A fits inside arbor hole 26A of spool 18A, and slides along a groove or track 30 formed along the inside edge of flange 22. A knob 32 along the outside edge of flange 22 provides the means to reel cords 10 in and draw cords 10 out. Track 30 should be of a width greater than the thickness of a handle lip 33 of handle 28A and of a depth slightly greater than lip 33 of handle 28A.

Handle 28R is used with spool 18 and rod 38 system, arbor hole 26 of a diameter slightly greater than rod 38, with rod 38 of a length greater than traverse 24. Rod 38 is inserted through arbor hole 26. Handle 28R is attached to rod 38 by arms 40 extending from rod 38. Both ends of rod 38 are inserted through openings 42 at the bottom of arms 40 the same size as arbor hole 26. A latch, screw, pin or cap 44 is inserted onto rod 38 to hold arms 40 in place. Arms 40 are of a length greater than flange 22 and connected by handle 28R.

Figures 1, 3A:
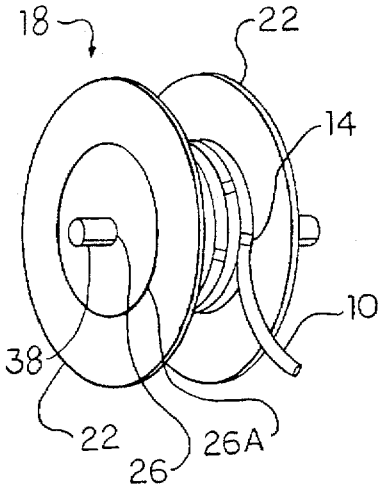
Figures 2, 3A:
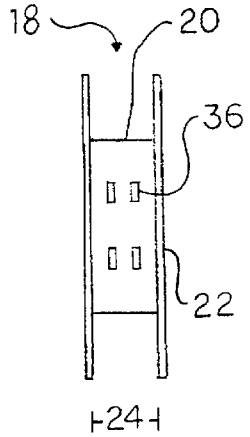
Figures 3, 3A:
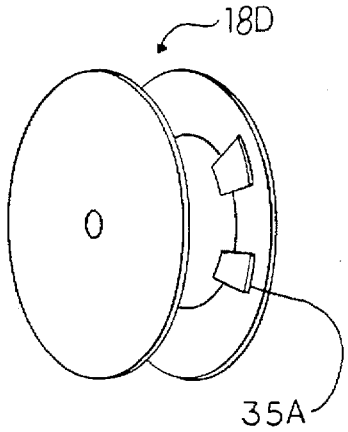
Figures 3, 3A, 4:
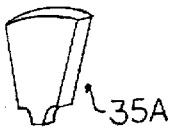
Figures 3, 3A, 4, 5:
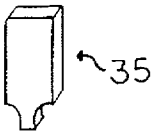
Figures 1, 3B:
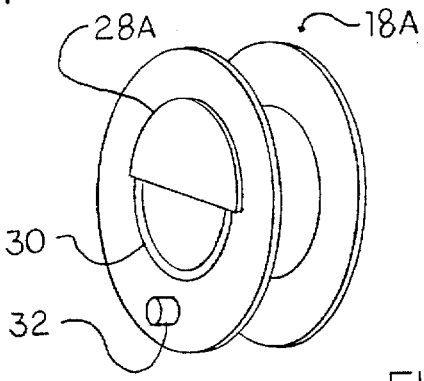
Figures 2, 3B:
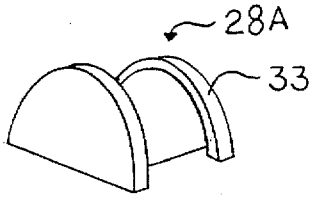
Figures 3, 3B:
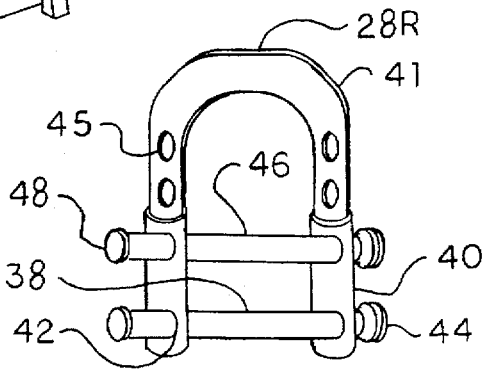
Figures 3, 3B, 4:
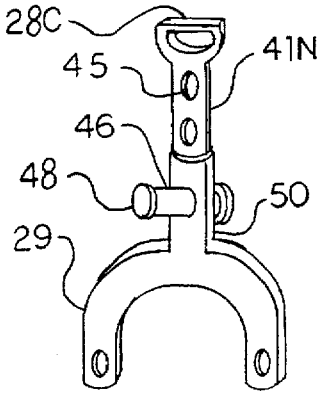
Figure 4A:
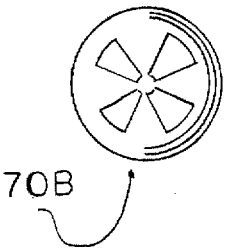
FIGS. 4A–4K are perspective views of equipment used with the present invention.
Figure 4B:
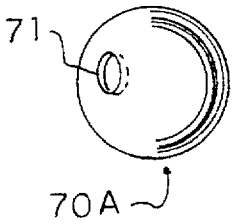
Figure 4C:
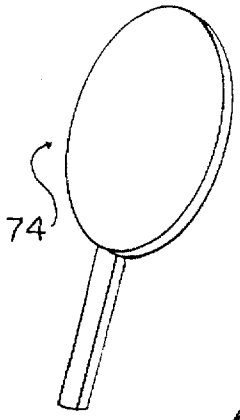
Figure 4D:
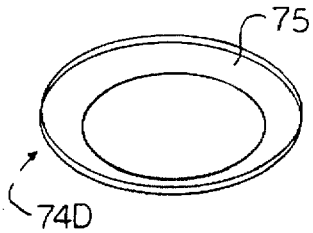
Figure 4G:
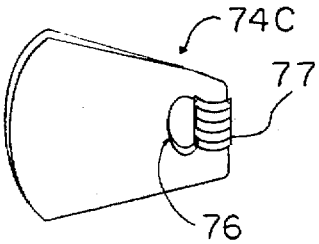
Figure 4H:
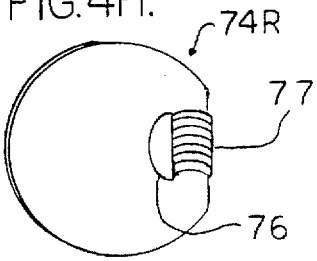
Figure 4E:
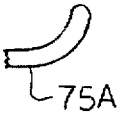
Figure 4F:
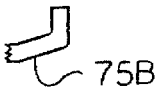
Figure 4I:
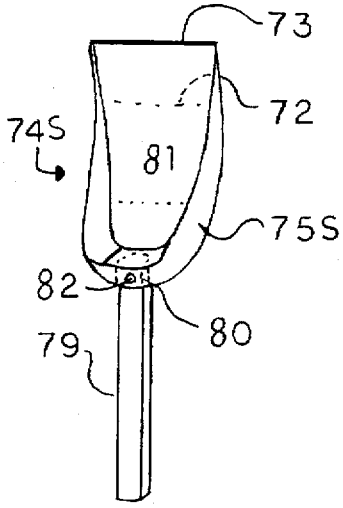
Figure 4J:
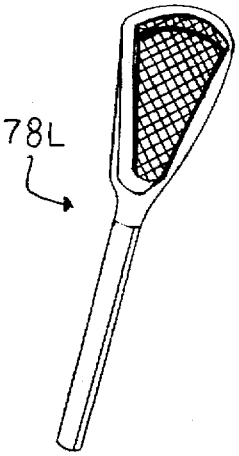
Figure 4K:
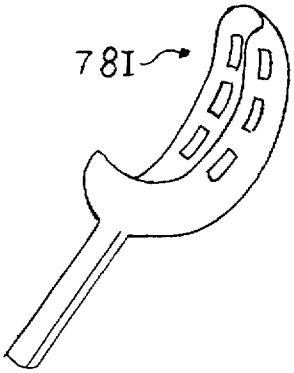

Extensions 41 are used to extend the distance of handle 28R above flange 22. FIGS. 3B-3–3B-4 illustrate telescoped extensions 41 of a lesser diameter than arms 40 extending from arms 40. The top end of arms 40 have a bolt hole 45 and extensions 41 several bolt holes 45 along the shaft the same diameter as bolt hole 45 on arm 40. Extensions 41 are raised or lowered to the desired length with bolt holes 45 on extension 41 lined up with bolt hole 45 on arm 40. A bolt 46 is inserted through the aligned bolt holes 45 and are attached by a fastener or nut 48 which also creates a second handle. Handle 28C has a telescoped extension 41N, extending from a neck 50 off legs 29 that are attached to rod 38. Extension 41A is secured with nut 48 and bolt 46. Extensions 41 and 41N are shortened for transport and hand winding of cords 10. Spool 18R, while hand held, is rotated to wind up and unwind cords 10 by grasping spool 18 by flange 22 and rotating while holding handle 28R with other hand. A crank, not shown, attached to rod 38, would replace knob 32 and provide a grip for rotating spool 18R. Extensions 41 and 41N are lengthened so that spool 18R rests on the ground and is held by a person standing erect. Spool 18R is rolled along the ground to wind up and unwind cords 10.

FIGS. 4A–4K—Equipment used with the present invention. These figures illustrate several options for equipment to be used in the boundary ball game of the present invention. While the boundaries can be used with any ball and paddle, racket, or stick combination that is on the market, several have been chosen to illustrate their unique contribution to the present invention. Balls to be used in combination with paddles and sticks are of plastic, foam, or rubber and any size, preferably between that of a table tennis ball and a softball. A rigid plastic ball 70A of a material that will emit glowing light, a hollow inside and a seal 71, and a ball 70B with holes through which a tube containing chemicals with glow properties can be inserted, are usable day and night. Paddles 74 are of solid, rigid material such as wood, plastic, graphite. A paddle disc 74D made of some form of plastic material, has an outer edge with a curved lip 75 similar to a flying saucer. The lip 75 forms an angle from the flat surface up to 90 degrees. A sectional view of lips 75A and 75B illustrates two appropriate angles. Unlike other paddles, the paddle disc 74A has no handle for a fist grip. Plastic paddles 74D of hollow construction, or hollow lips 75, can be constructed of a material through which glowing light can be emitted.

Paddle cone 74C and round paddle 74R illustrate grips 77 without shafts. A cutout 76 in paddle cone 74C and round paddle 74R is large enough for a hand to fit and grip the disc.

A lacrosse stick 78A or a jai alai stick 78B illustrate additional equipment that can be used in the boundary ball game of the present invention. A shoveled paddle 74S has a flat surface 72 on the back and a curved shovel edge 73 with curved shovel lip 75S that funnel from the outer edge to the inner edge forming a channel 81 on the front surface, with a shaft 79 inserted and attached to a socket 81 with a screw 82. Balls are hit in the manner of a paddle on the back side and flicked off shovel edge 73 in the manner used with a lacrosse stick 78A or jai alai stick 78B. Balls will not sit in a pocket as with the lacrosse stick and jai alai stick. Shovel paddles 74S are of various dimensions. Optimum dimensions for use in the boundary ball game of the present invention would suggest a width between six and ten inches and a length between eight and fourteen inches.

Volleyballs, soccer balls, and footbags, not shown, represent additional alternatives for use with the present invention that do not require a paddle, racket, or stick.

The remaining figures comprise various embodiments of the present invention each of which could be comprised of solid cords 10M and hollow connectors 14F or hollow cords 10F and solid connectors 14M. Thus, each will be described generically as cords 10 and connectors 14. Each of the remaining figures is comprised of a plurality of cords 10 and connectors 14. In order not to clutter and distort the plan views, repetitive parts are shown but not repetitively identified numerically.

Figures 1, 5A:
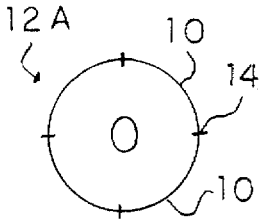
Figures 2, 5A:
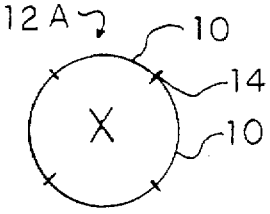

FIGS. 5A-1–5A-4, 5B-1, 5B-2—Field of play for teams. These figures comprise two embodiments of the present invention to create a field of play for teams. Boundaries are created by attaching cords 10 to connectors 14 to create the desired dimensions and shape. FIGS. 5A-1–5A-4 illustrate four separate and individual boundaries 12A each comprised of four cords 10 and connectors 14 for play with four players. Players in any two of the four boundaries are on one team and players in the other two boundaries are on the other team. In the embodiment of FIGS. 5A-1–5A-4, the "X"s represent players for one team and the "O"s represent players for the other team.

Figures 1, 5B:
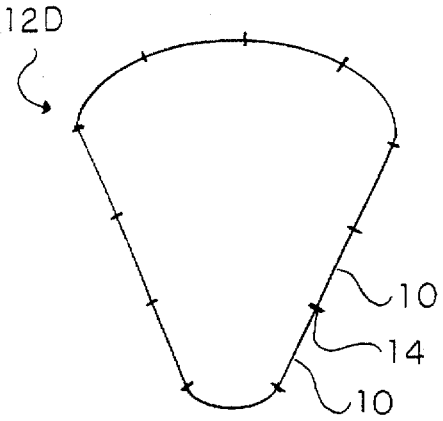
Figures 3, 5A:
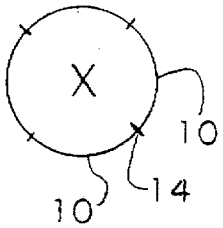
Figures 4, 5A:
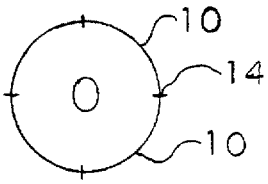
Figures 2, 5B:
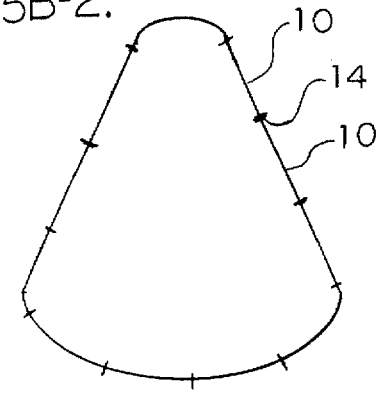

The second embodiment in FIGS. 5B-1–5B-2 illustrate a field of play for teams whereby the players on the same team would occupy the same boundary. Boundaries 12D are comprised of eleven cords 10 and connectors 14. The boundary dimensions and distance between boundaries are altered based on the space limitations and skill level of the players. As the number of players increases so likely should the number of cords 10. The "X"s represent players for one team and the "O"s represent players for the other team.

Figure 6A:
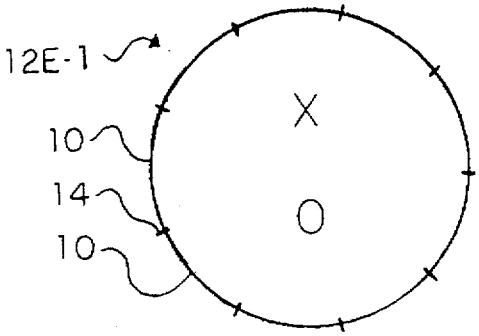
FIGS. 6A–6C are plan views illustrating one embodiment of the present invention for use in the boundary lacrosse game of the present invention.
Figure 6B:
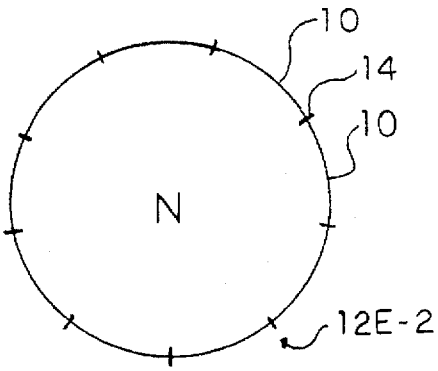
Figure 6C:
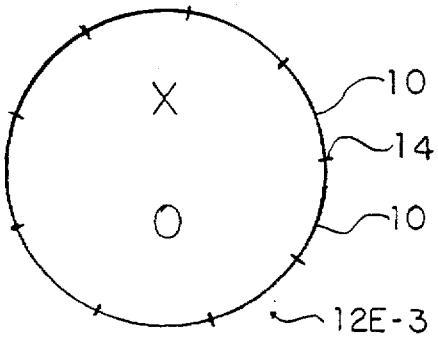

FIGS. 6A–6C—Field of play for boundary lacrosse. These figures illustrate an embodiment for the field of play in the boundary lacrosse game of the present invention. FIGS. 6A–6C are comprised of three boundaries 12E each of nine cords 10 and connectors 14. This is one example of an embodiment to be used with five or six players. Boundaries are added or eliminated to accommodate the number of players and dimensions are also altered based on skill level and space limitations. Two players occupy a boundary—one from each team. The "X"s represent players on one team and the "O"s represent the players on the other team. The "N"represents the neutral player when an odd number of players will participate. The minimum number of players is three; two within boundary 12E-1 and one within boundary 12E-2. The field of play defines the players area of movement.

Figure 7A:
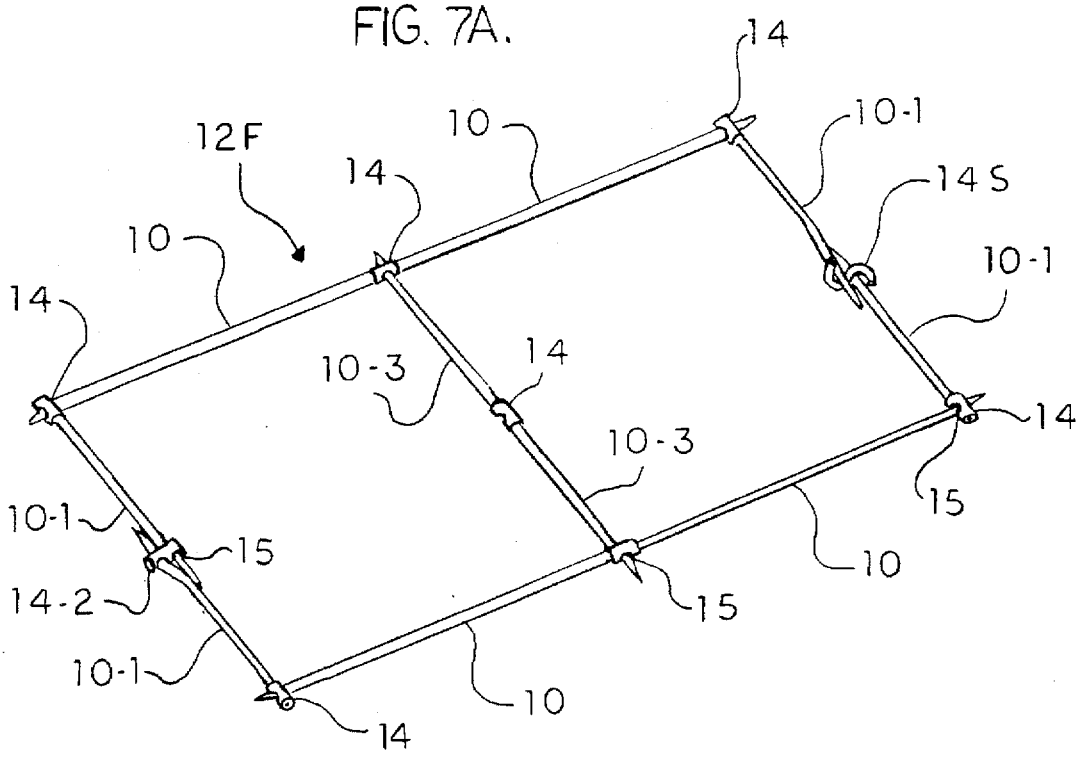
FIGS. 7A–7B are perspective views of the present invention illustrating two rectangular embodiments, one with and one without the use of connectors to form right angles.
Figure 7B:
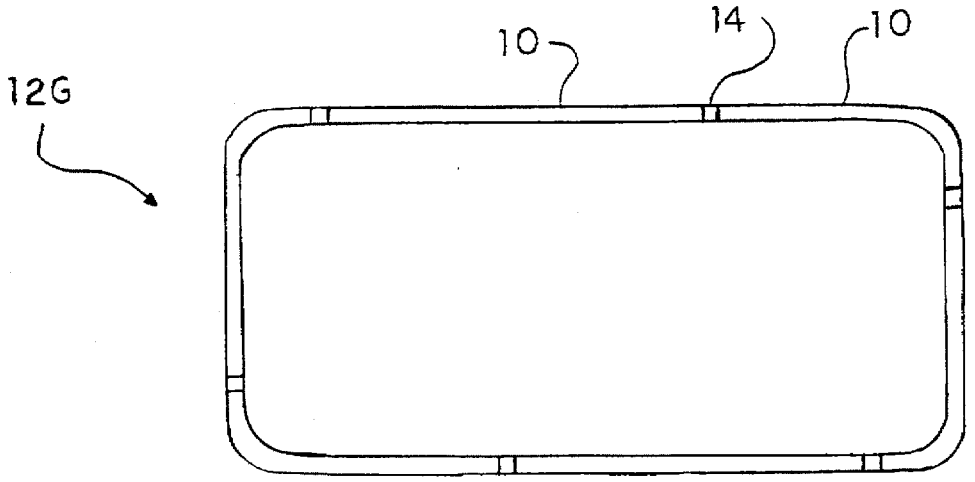

FIGS. 7A–7B—Rectangular field of play. These figures illustrates the versatility of the present invention as it comprises two embodiments of a rectangular field of play 12F and 12G. Field 12F is comprised with right angles created by utilizing cords attached to connectors 14 with cross-cut holes 15. By joining cords 10 to connectors 14 through the open ends, the desired length can be obtained. Corners are formed with connectors 14 attached to end cords 10 through cross-cut holes 15 and positioned along end cords 10 at the desired point. Any excess length of cords 10 lays outside the court area. The total length of the rectangular field of play 12F is created symmetrically for each side, exact positioning guided by ruler markings 19, shown in FIG. 2C.

To create the width, cords 10-1 are joined to the corner connectors 14 through the open end facing into the court and, depending on the desired width, additional cords 10 and connectors are added forming the back sides of the court. If less than two full lengths of cord 10-1 are needed, cords 10-1 are overlapped and connected by either an "S" connectors 14D or by connector 14-2 with two cross-cut holes 15, such as those illustrated in FIGS. 2E-1–2E-2. If a line is required through the middle of the court as comprised, cords 10-3 are inserted through cross-cut hole 15 of middle connector 14 and excess cord 10-3 extends outside the field of play. Cords 10-3 are connected in the middle of the court with connector 14. If a line is required through the court at a point along cord 10, connector 14 is slid onto cord 10 on each side of the field through cross-cut holes 15 and positioned at the appropriate point of intersection. While not shown, this assembly would look the same as the back lines formed by cords 10-1. Precise dimensions can also be created without overlap by varying the lengths of cords 10.

Often the precision of a field is not crucial, for instance, in a backyard volleyball game. Creation of the outside perimeter of the field, as illustrated in rectangular field 12G, does not require the use of cross-cut holes 15. Simply attach or unwind enough lengths of cords 10 and connectors 14 and form the rectangular field of play 12G with slightly rounded comers at the desired points. Lines through the middle of the field of play would require the use of connectors 14 with cross-cut holes 15 as comprised in rectangular field 12F.

Figures 8A, 8B, 8C:
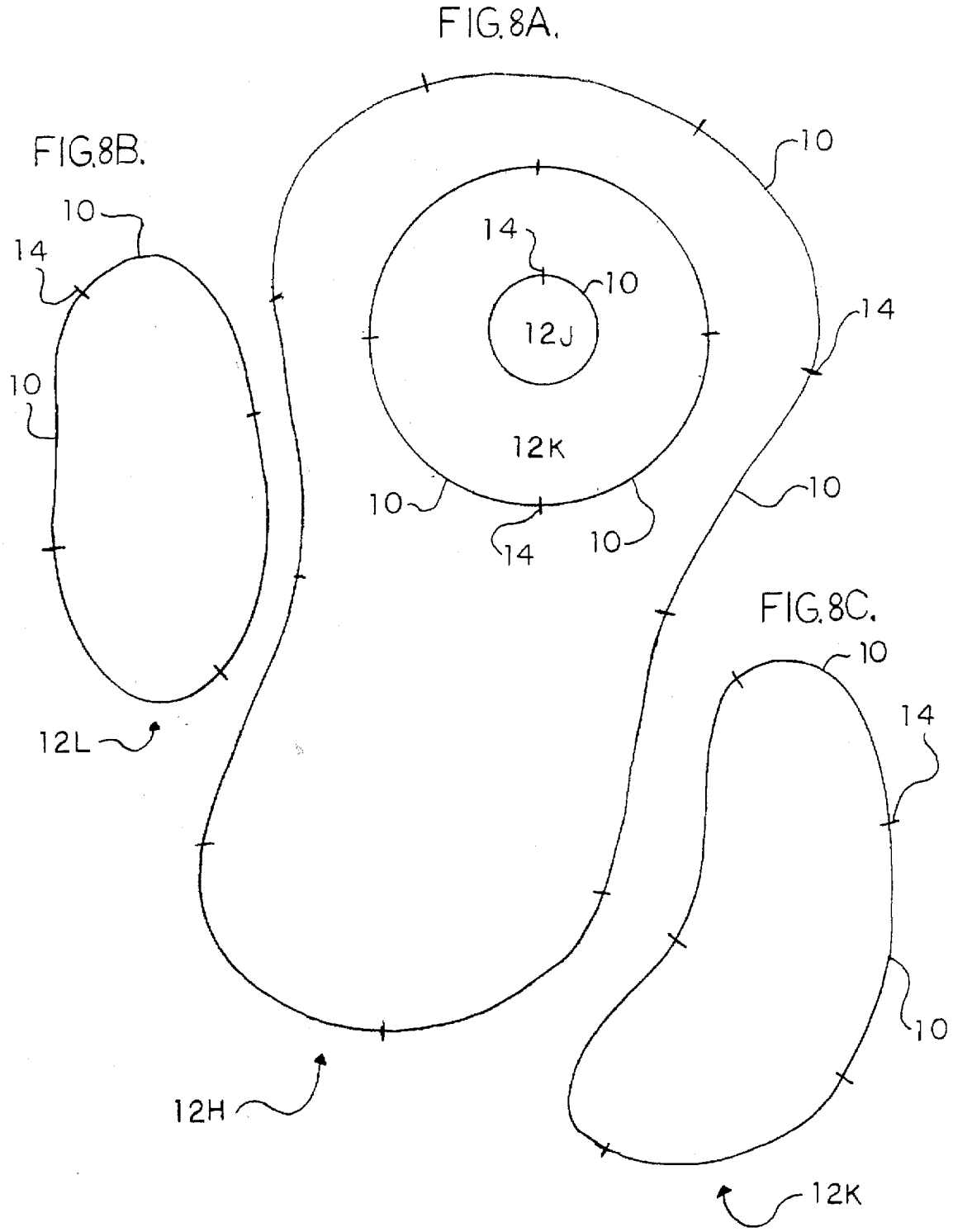
FIGS. 8A–8C are plan views illustrating one embodiment of the present invention for use in the boundary golf game of the present invention.

FIGS. 8A–8C—Golf green 12H and surrounding obstacles. These figures illustrate use of the present invention to simulate the area around a golf green 12H. Cords 10 and connectors 14 are attached to create the desired configurations and are distanced appropriately. Boundaries 12H, I, and J are formed within green 12H to designate a cup 12J, a one-putt range 12I, and two-putt range green 12H. Separate boundaries are formed of a plurality of cords 10 and connectors 14 to represent water hole 12K and sand trap 12L.

Figure 9A:
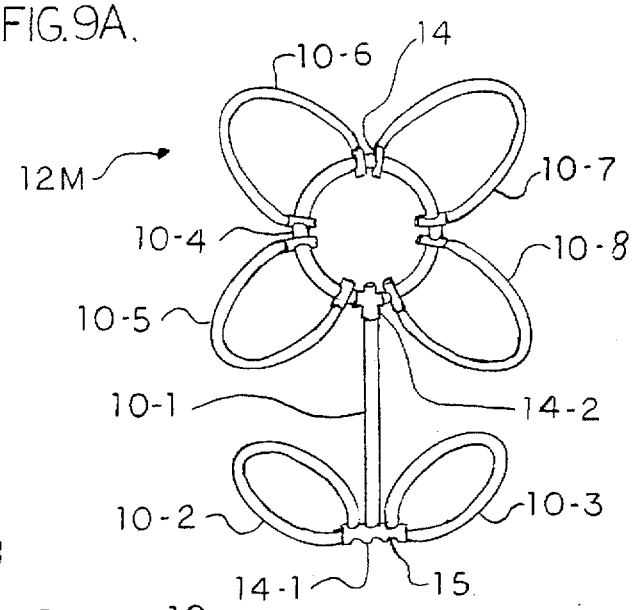
FIGS. 9A–9H are perspective views illustrating one embodiment of the present invention for use in artistic expression and plan view of seven embodiments of the present invention in artistic expression.
Figure 9B:
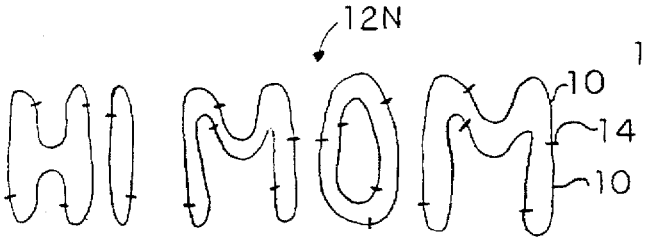
Figure 9E:
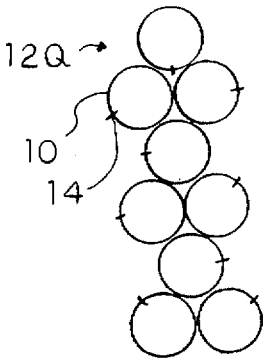
Figure 9C:
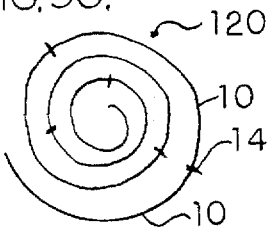
Figure 9D:
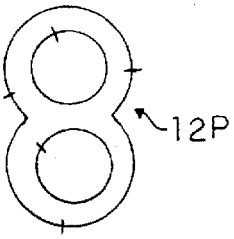
Figure 9F:
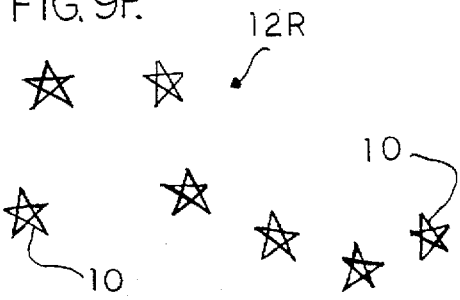
Figure 9G:
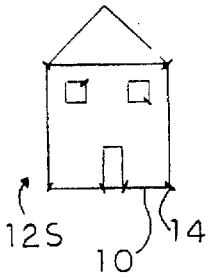
Figure 9H:
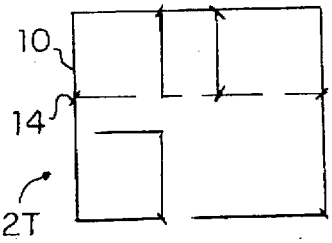

FIGS. 9A–9H—Artistic creation. These figures comprise eight embodiments of the present invention to create objects and games in the form of words, shapes, and pictures. By using the various connectors 14 and cords 10 illustrated in FIGS. 2A–2H, enlarged drawings can be formed on driveways, lawns, sand, sidewalks, and other surfaces. FIG. 9A illustrates the use of cords 10, connectors 14 with multiple points of intersection, and connectors 14 with one or more cross-cut holes 15, to form an enlarged flower 12M. Cord 10-1 represents the stem. Connector 14-1 with three cross-cut holes 15 is attached to the bottom of cord 10-1 through middle cross-cut hole 15. Cords 10-2 and 10-3 are attached to either open end of the connector 14-1, formed into a loop and attached at the opposite ends of cords 10-1 to the connector 14-1 through the two outside cross-cut holes 15 creating the leaves of flower 12M. Top end of cord 10-1 is attached to four-pointed connector 14-2. Cord 10-4 is attached to one of the adjacent points of connector 14-2. Ten connectors 14 are slid onto cord 10-4 and spread out along cord 10-4. Open end of cord 10-4 is then attached to connector 14-2 at the opposite adjacent end. Cords 10-5 through 10-8 are attached at both ends to adjacent connectors 14 to form the pedals of flower 12M.

FIGS. 9B–9H comprise a plan view with seven embodiments illustrating the present invention in artistic expression. The various embodiments include the words "HI MOM" 12N, a spiral 12O, a road or figure "8" 12P, a hop scotch court 12Q, stars or a big dipper 12R, the outside of a house 12S, and the inside rooms 12T. As with the rectangular fields of play 12F and 12G illustrated in FIGS. 7A–7B, the precision desired will be a determining factor as to which connectors 14 are used.

The flexibility of the cords 10 and connectors 14 enable boundaries to lay flat along any surface. If constructed on a driveway, cars driving over the configurations will not disfigure them significantly.

Main Embodiment—Operation

Holding spool 18R by handle 28R, a plurality of cords 10 attached with connectors 14 can be rolled out to the desired shape similar to the ground crew rolling out lime on a football field. Once the desired length is drawn out, cord 10 with connector 14 can be disconnected from the next cord 10 on spool 18R and attached to first cord 10 unwound from spool 18R forming an endless loop. The next boundary can be formed in the same fashion and can be situated any distance from the prior boundary. In order to store, cords 10 can be wound back onto spool 18R by first detaching one end of one connector 14 in the configuration from cord 10 and attaching it to the last cord 10 on spool 18R. With each flange 22 of spool 18R straddling the cord 10 laid out on the ground, spool 18R can be rolled along the boundary lines, winding the remaining cords 10 back onto spool 18R. With hand held spool 18A and 18R, cords 10 can be wound and unwound in a similar manner, walking along the desired boundary line either winding or unwinding cords 10 with knob 32 or grasping flange 22.

The ability to detach and reattach the plurality of cords 10 at the desired length is like being able to cut a line at any point and reattach it again once finished and do this over and over without having to tie the rope up in knots to reattach.

In order to set up a field of play for the boundary ball game of the present invention, several boundaries can be formed, such as in FIG. 1. The boundary dimensions are determined with each usage by the number of players, including an odd number, space limitations and skill levels of the players. More experienced players should be required to defend boundaries of a greater dimension, creating a form of "handicapping" to aid the less skilled players.

The boundary ball game of the present invention requires two or more players. The object of the game is to prevent the ball from landing within your own boundaries while at the same time directing the ball into an opponent's boundary. Points in the individual game are not gained by successful shots into an opponent's boundary. Points are lost by the player whose boundary the ball lands. For experienced players, points should also be lost for not successfully hitting the ball to within the opponent's boundary—out of bounds. Players are staked to a set number of markers (points). Any player losing all markers is eliminated and the game ends once all but one player has markers remaining. Serve starts with one player hitting the ball in an upward arc towards an opponent's boundary.

In the team game and a game with only two players, points are gained by successful shots, similar to that of a volleyball game. Rules could be altered to add points on every serve, thus the serving team is not the only team that can score points.

Score can be maintained via a scoreboard, objects that represent markers, or in one's head.

The boundary ball game of the present invention can be played with any paddle and ball combination on the market. Paddles 74C, D, R, S, illustrated in FIG. 4, add to the uniqueness of the boundary ball game. The primary position for holding paddle disc 74D requires placing the thumb on the inside and the other four fingers flat on the outside. This can be done with one or both hands. Use of paddle disc 74D requires developing skills unique to the boundary ball game. It also facilitates longer volleys since a downward swipe at a ball could catch curved lip 75 and direct the ball straight down. The most efficient motion with this hold is an upward swing starting from the hip or lower. Curved lip 75 helps scoop and direct a very low shot up into the air on an upward swing. If paddle disc 74D was held in the opposite position, with thumb(s) on the outside and fingers curled inside around curved lip 75, paddle disc 74D would be in an appropriate position for hitting a ball that is chest level or higher.

Use of a lacrosse type stick 78L and a jai alai type stick 78J further illustrates the versatility provided with the present invention. Since control of the ball is greater with equipment having a pocket in which the ball can rest, the size of the boundaries may have to be decreased and the distance between boundaries increased in order to have a game that will have volleys. Other rules may have to be added such as limiting the time a player can hold the ball. Use of shovel paddle 74S would create a game requiring a combination of stick skills and paddle skills. The ball can be flicked off curved shovel edge 73 in a motion similar to that used with the lacrosse stick or jai alai stick or stroked at in a motion similar to that used with paddle 74.

Unique rules have also been created for use of the boundaries of the present invention with the lacrosse stick 78L and jai alai stick 78J. These rules do not follow the basic rules of the boundary ball game of the present invention. The rules require action more similar to the lacrosse and jai alai games. With an even number of players, each team has one player within each of the boundaries 12E. As illustrated in FIG. 6, the "X"s represent players from one team and the "O"s represent players from the other team. The object is to pass and catch with your teammates while the other team defends. Once a set number of catches are made by one team they win the game. If there is an odd number of players, one player is designated the neutral or point person "N", occupies one boundary 12E-2 alone or roams free, and alternates assisting the team in possession of the ball. Point person "N" must attempt to pass the ball to a player on the same team that just passed the ball to the point person. If the defenders intercept the ball, the point man now assists their team. The boundary lacrosse game promotes the skills required to play the true game of lacrosse by providing game type conditions without a goal.

A volleyball type game, hitting the ball with your arms and hands, can also be played using the boundaries of the present invention and the basic boundary ball rules for individual or team play without the need for a volleyball net. Soccer or footbags games can be created with the boundaries of the present invention as well.

A rectangular field of play 12G, illustrated in FIG. 7 without precise right angles, can be formed in a similar fashion as the other boundaries, rolling out cords 10 into the desired shape. Precise dimensions are often not necessary especially in the backyard or beach game and thus it may not be required to use cross-cut holes 15 to set up precise dimensions. The luxury of the boundaries of the present invention is the ability to adapt to the requirements of the user, approximate or exact, and create any shape without being limited to one set boundary form. The detachable feature also results in the ability for multiple uses simultaneously. The boundary system of the present invention does have the connectors 14 necessary to create a rectangular field 12F with true right angles if so desired. Additional connectors 14 would have to be added through cross-cut holes 15.

The boundary golf game of the present invention uses a field of play created in the same manner as the other boundary games, rolling out cords 10 off spool 18 to the desired length and attaching with connectors 14 to form the shapes desired. FIG. 8 illustrates one embodiment of the boundary golf game with one water hole 12L and one sand trap 12K. Once the ball lands within green 12H, shots are no longer made. Since the game is not being played on a true golf green, strokes are added as one-putt or two-putts according to the location of the ball. Balls hit outside green 12H must be hit again. If hitting from sand trap 12K add one stroke and from water hole 12L add two strokes and, in both instances, hit again.

Any of the ball games would have an added unique dimension of being playable day and night with the use of cords 10 and balls 70A and 70B of florescent, glowing material, or material through which glowing light can be emitted. Glowing paddles 74D could be used but would not be required in the dark.

The multiple use capability of the boundaries of the present invention is illustrated in FIG. 9. A variety of shapes can be created and enhanced with various colors for cords 10 and connectors 14. The boundaries of the present invention expand the possibilities for creating games and art. With these boundaries, enlarged pictures, or a new form of clean graffiti, can be drawn on a lawn, driveway, beach, and other surfaces. Games such as hop scotch that is normally played on cement can be played in the grass or sand. The glow in the dark feature of cords 10 adds to the brilliance of drawings such as stars.

While a plurality of cords 10 reaching a length of several hundreds of feet can to stored and transported using the spool 18, it is also very simple to detach the desired length if only a few lengths of cord 10 are needed. Packaging of less than 100 feet would be sufficient to supplement the multitude of two paddle games currently being marketed. Since individuals often supply their own equipment such as lacrosse sticks, packaging lengths can be based on individual needs in which case individual cord 10 lengths may more appropriately be between thirty and fifty feet. Saddles 37 and clip/hooks 60, illustrated in FIG. 3D, may be more appropriate for lesser overall length requirements.

Conclusions, Ramifications, and Scope

Accordingly, it can be seen that, according to the invention, an adjustable boundary layout and apparatus can be constructed of cords and connectors which can easily be stored on a spool, and have the flexibility to provide an easy method for creating a variety of shapes of any size for use with ball games as well as artistic configurations. The system is not limited to a single dimension nor for a single purpose or age group, and the limited lengths facilitate creation of enlarged multiple configurations at the same time of multicolors and glowing cords. The boundaries promote creativity in artistic form and competitiveness in ball and paddle games.

Although the description above contains many specifications, these should not be construed as limiting the scope of the invention but as merely providing illustrations of some of the presently preferred embodiments of this invention. Various other ramifications are possible within it's scope. For example, many other words can be created from the present invention. The boundaries can also be used with many other games such as for creating safety zones for tag or the foul lines on a baseball field. Other forms of connectors can be created with three to ten ends or more. Paddles can vary and balls may be smaller than a table tennis ball or larger than a softball. Other materials could be used as well as additional methods of connection. The length of the cords could be less than a foot or more than fifteen feet.

Thus the scope of the invention should be determined by the appended claims and their legal equivalents, rather than by the examples given.

I claim:

1. An adjustable boundary layout and apparatus for marking boundaries and outlining any shape comprising:

a) a plurality of flexible demarcation elements and b) a plurality of connecting elements, c) detachable connecting means for attaching said demarcation elements to said connecting elements and for detaching of said demarcation elements from said connecting elements, improvement whereby the overall length and configuration are determined by the end-user at time of each usage, whereby several separate and distinct usages can exist simultaneously, d) detachable connecting means used to intersect and overlap said demarcation elements at any point along said demarcation element, improvement whereby said connecting element can be attached to said demarcation element and adjustably positioned at any point along said demarcation element, e) spooling means for collecting, unwinding, and transporting said demarcation elements attached to said connecting elements as a continuous form, without tangling, bulging, disconnecting.

2. An adjustable boundary layout and apparatus as in claim 1 wherein said detachable connecting means comprises connecting elements with at least one crosscut opening through which said demarcation element can be inserted and adjustably positioned, creating a point of intersection at any point along said demarcation element, also creating a point of overlap wherein excess lengths of said demarcation element lie parallel to one another, and a point of attachment for multiple demarcation elements, each connected through a different crosscut hole of same said connecting element, or through crosscut holes of an adjacent connecting element.

3. An adjustable boundary layout and apparatus as in claim 1 further comprising said detachable connecting means as said connecting elements with multiple points of intersection for which a plurality of said demarcation elements can be attached to a single said connecting element.

4. An adjustable boundary layout and apparatus as in claim 1 wherein said demarcation elements are of various lengths and color, said demarcation elements containing ruler markings from which length can be determined and for which positioning of said connecting element can be determined, improvement whereby said demarcation elements can be positioned by the user in the desired color combination.

5. An adjustable boundary layout and apparatus as in claim 1 with containment means for maintaining material within said demarcation elements, said connecting elements acting as plugs to maintain said material within said demarcation elements, said demarcation elements of a form from which glowing light can be emitted.

6. The adjustable boundary layout and apparatus of claim 1 wherein said spooling means for collecting, unwinding and transporting comprises a spool with a handle affixed within an arbor hole and a rotating means about said handle for winding and unwinding up to several hundred feet of said demarcation elements attached with said connecting elements on or off said spool, improvement whereby dividing means comprises detachable pegs that can be inserted into the barrel of said spool to separate said demarcation elements.

7. The adjustable boundary layout and apparatus of claim 6 wherein said handle is affixed above said spool, attachment means being arms attached to a rod on which said spool rotates, said arms raised up to several feet above said spool flange, extension means for adjustably extending the length said arms can be raised, said spool held by said handle, improvement whereby rotating means with said spool hand held and with said spool rolling along surface to wind and unwind said demarcation elements.

8. An adjustable boundary layout and apparatus for marking a field of play of any shape for use in playing a ball game comprising a) a projectile, b) a plurality of flexible demarcation elements, and c) a plurality of connecting elements, d) detachable connecting means for attaching said demarcation elements to said connecting elements and for detaching of said demarcation elements from said connecting elements, whereby several separate and distinct boundary configurations are formed by connecting said demarcation elements and said connecting elements until the desired dimensions are obtained, then attaching first said demarcation element to last said connecting element to form an endless loop, the dimensions and shape determined for each player at the time of usage based on space limitations and skill level of the players, the space within the boundaries being the area to be defended by the player occupying the boundary, the space outside of and between all the boundaries, determined by space limitations and skill level of players, being out-of-bounds, object of game being to direct ball within opponents' boundary while not allowing ball to land within own boundary, e) hitting means for directing said projectile into opponents' boundaries, f) spooling means for collecting, unwinding and transporting said demarcation elements and said connecting elements as a continuous form without tangling, bulging, disconnecting.

9. A method of playing game with the apparatus of claim 8 without teams and at least two players, each defending their own boundary with points lost if said projectile lands within ones boundary, points also lost, at option of players decided before play begins, for said projectiles hit out of bounds, each player staked to a set number of points, the winner being the only player with points remaining, improvement whereby an odd number of players can participate.

10. A method of playing game with the apparatus of claim 8 with said projectile a ball and said hitting means to direct said ball within boundaries a paddle, wherein said paddle is comprised of plastic in the form of a disc with a curved outer lip and no handle, improvement whereby said paddle best suited for arcing shots prompting longer volleys.

11. The method of claim 10 wherein said balls and said demarcation elements are of material through which light can be emitted, containment means for maintaining material within said balls and said demarcation elements with glow properties.

12. A method of playing game with the apparatus of claim 8 with said projectile a ball and said hitting means to direct ball within boundaries a shovel paddle having a handle and a pocket of a depth and shape that will allow said ball to roll off as with a jai alai or lacrosse stick and be hit as with a paddle, depth shallow enough so that ball cannot sit inside.

13. A method of playing game with the apparatus of claim 8 with said projectile a ball and said hitting means a lacrosse and jai alai type sticks to catch and throw said ball, action similar to that of lacrosse and jai alai, said game played with at least three players, each team having one player within each boundary, the size determined by space limitations and skill level of players, scoring means successful completion of a set number of passes between teammates, the required number to win determined by the players prior to the onset of said game, passes attempted while the team not in possession attempts to gain possession, said ball landing on ground inside or outside of boundaries rewarded to the team defending, said game, if played with an odd number of players, requiring one player being designated as neutral and being required to pass and catch with the players in possession.

14. A method of playing game with the apparatus of claim 8 wherein said projectile is a golf ball, said detachable connecting means used to attach multiple said demarcation elements to create a green with a cup and putting ranges, and simulated obstacles, scoring means determined by the location of said ball within said demarcation elements.

15. An adjustable boundary layout and apparatus for marking the outline of any shape in artistic expression comprising:

a) a plurality of flexible demarcation elements, b) a plurality of connecting elements, and c) detachable connecting means used to attach, detach, intersect and overlap a plurality of said demarcation elements with intersection at any point along said demarcation element, improvement whereby said connecting elements can be attached to said demarcation element and adjustably positioned at multiple points along said demarcation element, improvement whereby said demarcation elements can be attached to form enlarged configurations, d) detachable connecting means for altering the color of each said demarcation elements, improvement whereby users can determine the color combination creating appropriately colored designs.

* * * * *